US007163215B2

(12) United States Patent
Mathis et al.

(10) Patent No.: US 7,163,215 B2
(45) Date of Patent: Jan. 16, 2007

(54) FRONT SUSPENSION TUNING APPARATUS

(75) Inventors: William Mathis, Margate, FL (US); Lyew Christopher, Lake Worth, FL (US)

(73) Assignee: Steeda Autosports, Inc., Pompano Beach, FL (US)

( * ) Notice: Subject to any disclaimer, the term of this patent is extended or adjusted under 35 U.S.C. 154(b) by 134 days.

(21) Appl. No.: 10/998,073

(22) Filed: Nov. 26, 2004

(65) Prior Publication Data

US 2005/0073120 A1 Apr. 7, 2005

(51) Int. Cl.
*B62D 17/00* (2006.01)

(52) U.S. Cl. ..... 280/86.753; 280/86.751

(58) Field of Classification Search ..... 280/86.751, 280/86.753, 86.754
See application file for complete search history.

(56) References Cited

U.S. PATENT DOCUMENTS

| | | | | | |
|---|---|---|---|---|---|
| 4,372,575 | A | | 2/1983 | Hyma | |
| 4,619,465 | A | * | 10/1986 | Johnson | 280/86.753 |
| 4,706,987 | A | * | 11/1987 | Pettibone et al. | 280/86.753 |
| 4,733,884 | A | * | 3/1988 | Pettibone et al. | 280/86.753 |
| 4,736,964 | A | * | 4/1988 | Specktor | 280/86.75 |
| 4,863,187 | A | * | 9/1989 | Artz | 280/86.753 |
| 4,946,188 | A | | 8/1990 | Key et al. | |
| 4,948,160 | A | * | 8/1990 | Barry | 280/86.753 |
| 4,971,352 | A | * | 11/1990 | Jordan | 280/86.754 |
| 5,044,659 | A | * | 9/1991 | Specktor et al. | 280/86.753 |
| 5,104,141 | A | * | 4/1992 | Grove et al. | 280/86.753 |
| 5,129,669 | A | * | 7/1992 | Specktor et al. | 280/86.753 |
| 5,163,699 | A | * | 11/1992 | Specktor | 280/86.753 |
| 5,382,043 | A | * | 1/1995 | Jordan | 280/86.753 |
| 5,484,161 | A | | 1/1996 | McIntyre | |
| 5,647,606 | A | * | 7/1997 | Jordan | 280/86.751 |
| 5,779,260 | A | * | 7/1998 | Reilly et al. | 280/86.754 |
| 5,931,485 | A | | 8/1999 | Modinger et al. | |
| 6,224,075 | B1 | | 5/2001 | McIntyre | |
| 6,244,604 | B1 | * | 6/2001 | McIntyre | 280/86.753 |
| 6,257,601 | B1 | | 7/2001 | Spears et al. | |
| 6,328,321 | B1 | | 12/2001 | Nolan | |
| 6,485,223 | B1 | | 11/2002 | Van Schmus et al. | |

OTHER PUBLICATIONS

JEG's Product Brochure, "SPC Dodge Truck Camber/Caster Kits", www.jegs.com (Jul. 7, 2005).
JEG's Product Brochure, "SPC Ford 4WD Caster/Camber Sleeves", www.jegs.com (Jul. 7, 2005).
JEG's Product Brochure, "SPC Jeep/Dodge Offset Ball Joints", www.jegs.com (Jul. 7, 2005).
Mustang Stuff Product Brochure, "Mustang Caster/Camber Plates", www.v6mustangstuff.com (Jul. 7, 2005).
Focus Sport Product Brochure, "Camber kits", www.focussport.com (Jul. 7, 2005).
Proficient Performance Product Brochure, "BBK aluminum adjustable caster/camber package for 79-93 Ford Mustang", www.proficientperformance.com (Jul. 7, 2005).

* cited by examiner

*Primary Examiner*—Eric Culbreth
*Assistant Examiner*—Barry Gooden, Jr.
(74) *Attorney, Agent, or Firm*—McHale & Slavin, P.A.

(57) ABSTRACT

The present invention provides a suspension tuning device for vehicles with struts. More specifically, the suspension tuning device generally comprises a pair of plates constructed to mount juxtaposed to the strut/spindle mounting flange of a standard MacPherson strut, each plate includes an inset sub-plate having an offset aperture which cooperates with one of the spindle attachment bolts to control wheel camber.

15 Claims, 3 Drawing Sheets

FRONT SUSPENSION TUNING APPARATUS

FIELD OF THE INVENTION

The present invention relates to a device for quickly and easily adjusting camber of a vehicle front suspension across a broader than normal range to tune the vehicle's suspension for racing and/or high performance street applications.

BACKGROUND OF THE INVENTION

The versatility and performance of newer muscle cars such as the FORD MUSTANG permit owners to use one vehicle for multiple purposes. Often the same vehicle used to carry groceries home from the supermarket is used for racing applications on the weekend. Owners will often modify their vehicle to make it more competitive in their chosen form of racing. One of the most modified areas of a vehicle for racing applications is the suspension.

Front suspension tuning can be one of the most critical aspects of getting a vehicle to handle properly for either street or racing applications. Unfortunately, front suspensions that are modified exclusively for racing typically will not work properly for street driving, and street suspensions typically do not work well for racing. One of the biggest challenges for a muscle car owner who races his vehicle has been to balance the vehicle for both uses.

The front wheel of a vehicle has three main alignment angles: camber, caster, and toe. Camber is the angle at which the top of the tire is tilted inwardly or outwardly, as viewed from the front of the car. If the top of the tires lean toward the center of the car you have negative camber. If the top of the tires are tilted outward you have positive camber. Typically, as the tires are turned left and right, the camber changes slightly because the pivoting points for the tires are not vertical as viewed from the side. Adjusting camber can have a dramatic affect on the cornering characteristics of a vehicle. For example, an oval track racer will often race with negative camber on the right side of the vehicle and positive camber on the left side of the vehicle. A drag racer will often race with neutral or slightly negative camber on both sides of the vehicle and a street vehicle will typically have camber set at zero or perpendicular to the street surface.

Caster is the angle at which the pivot points for tires are tilted, as viewed from the side. Caster is best understood by imagining an axis running through the uppermost wheel pivot and extending through the lowermost pivot. From the side, if the top of the axis tilts toward the back of the car you have positive caster, if the axis line tilts toward the front of the car you have negative caster. If a vehicle has positive caster, the uppermost pivot is behind the lower pivot and this causes the tire to tilt in more at the top as the tire is steered inward (camber gain).

Changing caster primarily affects four things: high speed stability, camber gain, bump steer characteristics, and relative corner weights (wedge). Increasing caster generally increases straight line directional stability. This is good for an application such as drag racing, however, other parameters such as bump steer and wedge may be adversely affected making handling for applications such as street driving or road racing unacceptable. Excessive caster settings will increase required steering effort, cause excessive tire wear and reduce braking ability. Negative caster requires less steering effort, but directional stability is adversely affected. Some racing applications may require different caster settings on each side of the vehicle. For example, oval track racers often run more positive caster on the right side wheel than the left. The caster split helps pull the car down into the turn, helps the car turn in the center of the turn, and helps the car maintain traction exiting the turn.

Accordingly, what is lacking in the art is a suspension tuning kit for vehicles with struts. The suspension tuning kit should achieve objectives such as providing: quick adjustment, increased suspension rigidity, increased range of adjustability and reliable performance. The suspension tuning kit should include packaging flexibility for installation on various vehicle configurations including retrofitting existing vehicles with minimal modification of the original suspension system. The suspension tuning kit should facilitate independent caster and camber adjustment of each front wheel across the extended range. The suspension tuning kit should facilitate quick suspension changes to allow a vehicle to be driven to a racetrack, converted to a race setup, and thereafter quickly converted back to a street driving setup for the trip home.

DESCRIPTION OF THE PRIOR ART

A number of prior art systems exist for adjusting the caster and/or camber of a vehicle which utilizes struts. Most of the systems utilize a combination of thin stamped metal plates and rubber bushings, while others use eccentric cams or jack bolts.

U.S. Pat. No. 4,372,575 discloses a vehicle wheel suspension including a strut member provided at its lower end with a wheel spindle and a connection with a lateral lower control arm. The device further includes mounting apparatus for attaching the upper end of the strut to a stamped sheet metal tower portion of the vehicle and provisions for adjustment of either wheel caster or wheel camber via a stamped sheet metal adjuster attached to the upper end of the strut.

U.S. Pat. No. 4,946,188 discloses an adjustment mechanism for a MacPherson strut of an automobile. The adjustment is provided by modifying the top bearing retainer to provide an inward circular lip. Two plates are clamped to this lip. Before clamping, the plates are rotatable relative to the bearing retainer so that the center of an eccentric hole therein moves along a circle which is concentric to the bearing retainer and thus the bearing. The upper end of the piston rod of the strut is mounted in the eccentric hole so that the position of the upper end of the strut can be moved relative to the body and also within the bearing and helical spring.

U.S. Pat. No. 5,484,161 discloses an adjustable mount for the upper end of a motor vehicle suspension strut, wherein a flange is located between a clamping plate and a face plate with studs passing from the clamping plate through enlarged apertures in the flange. Holes in the face plate and aligned holes in the top of the vehicle chassis suspension tower are securable by nuts. Before the nuts are tightened, the flange may be moved in a sliding fashion between the clamping plate and face plate to locate the bushing and upper end of the strut into the desired location for correct caster and camber settings. Reference is also made to the provision of screwdriver slots to permit the flange to be levered into the desired location using a screwdriver when the suspension is under load.

U.S. Pat. No. 5,931,485 discloses a support arrangement for a steered vehicle wheel mounted on a wheel carrier which is supported by a transverse link by way of a ball joint with a flange pivotally supported and mounted on the transverse link by clamping screws extending through spaced mounting holes in the transverse link and the mounting flange. The mounting holes in one of the transverse link and mounting flange is formed by at least three different receiving bores disposed at different distances from the pivot point of the flange for receiving the clamping screws and the mounting holes. In the other are holes elongated along a line extending through the pivot point between the transverse link and the flange and forming jointly with the screws stops which provide for positive engagement between the transverse link and the flange in each of the different relative pivot positions between the two.

U.S. Pat. No. 6,224,075 discloses a caster adjuster for a motor vehicle suspension, typically having a wishbone. The device is made adjustable by mounting the suspension upright ball joint in a housing having an offset spigot rotatable by an Allen key engaged in the spigot to move the ball joint backward and forward while the spigot is restrained by a slot in a location bracket engaged with the wishbone. Camber is adjusted by a threaded adjuster operable between the location bracket and the housing while allowing rotation of the housing relative to the bracket.

U.S. Pat. No. 6,257,601 discloses an adjustable strut mounting plate for correcting at least one alignment parameter of a motor vehicle wheel assembly, with the adjustable strut mounting plate comprising an annular body adapted for secure attachment to the original strut mounting plate of the motor vehicle. The adjustable strut mounting plate includes a plurality of elongated ribbed adjustment bores through which bolts pass to secure the original strut mounting plate to the adjustable mounting plate. In addition, right hand and left hand tower mounting bores are provided in the adjustable strut mounting plate to accommodate attachment of the combined adjustable strut plate with the original strut plate to the vehicle tower.

U.S. Pat. No. 6,328,321 discloses an adjustable mount for the upper end of a vehicle suspension strut which allows the strut to be relocated relative to a vehicle chassis member. The mount comprises a bushing adapted to receive and secure the upper end of the strut, a flange extending radially outwardly from the bushing, and a clamping plate adapted to abut the lower face of the flange. The flange has upper and lower faces, and the clamping plate has an opening therethrough larger than the perimeter of the bushing such that the clamping plate can relatively slide over the lower face of the flange over a limited area. A plurality of studs extend upwardly from the clamping plate. The studs are located outside the periphery of the flange and restrict the sliding movement of the flange relative to the clamping plate by engagement with the periphery of the flange.

U.S. Pat. No. 6,485,223 discloses a caster-camber plate assembly which includes a base plate, a main plate and a strut top mounting plate. The base plate includes four spaced apart main plate fastening members attached thereto. The main plate includes four spaced apart strut top mounting plate fastening members attached thereto. The main plate has the main plate fastening members extending therethrough for attaching the base plate adjacent to a first side of the main plate and is capable of being moved with respect to the base plate along a first translation axis. The strut top mounting plate is positioned adjacent to the main plate with the four strut top mounting plate fastening members extending therethrough. The strut top mounting plate is capable of being moved with respect to the main plate along a second translation axis. The second translation axis extends approximately perpendicular to the first translation axis. A central axis of the strut top mounting plate is positioned within an area defined between the main plate fastening members and within an area defined between said strut top mounting plate fastening members.

The construction of this device places the strut mount plate on top of the main plate, whereby a catastrophic fastener failure will result in the strut being thrust through the vehicle hood and loss of vehicle control. Moreover, the strut mounting position (height) within this device prevents the strut from being positioned at the original equipment manufacturers (OEM) suggested height. Still yet, this construction requires spacers between the main plate and the strut tower to accommodate the heads of the fasteners. The spacers reduce the contact area between the main plate and the strut tower thereby reducing rigidity of the vehicle front suspension.

As disclosed, the above devices fail to teach or suggest a suspension tuning mechanism capable of the large range of camber adjustments required for high performance applications. The prior art is also deficient in teaching a suspension tuning mechanism capable of providing the camber travel required to properly align the front wheels of vehicles having lowered ride heights. Further, the prior art devices do not provide the suspension rigidity and stability required by high performance and/or racing vehicles. Still further, the prior art devices do not provide a suspension tuning mechanism which cooperates with the lower portion of a strut member to provide wheel camber adjustments without alteration of the vehicle's roll center.

SUMMARY OF THE INVENTION

The present invention provides a suspension tuning device for vehicles with struts. More specifically, the suspension tuning device generally comprises a pair of plates constructed to mount juxtaposed to the strut/spindle mounting flange of a standard MacPherson strut, each plate includes an inset sub-plate having an offset aperture which cooperates with one of the spindle attachment bolts to control wheel camber. The cooperating plates and sub-plates permit front suspension camber alterations throughout an increased range when compared to the prior art.

The pre-existing vehicle strut tower includes a thin sheet metal mounting member constructed for attaching the upper portion of a strut member via a stamped metal plate. The mounting member typically includes three elongated slots arranged to cooperate with the stamped metal plate to permit the upper portion of the strut member to be pivoted inward for a small amount of camber adjustment. When the upper portion of the strut is pivoted inwardly or outwardly the roll center of the vehicle is altered and vehicle handling and stability may be detrimentally affected.

The instant invention provides a suspension tuning kit which operates in conjunction with, or replaces, the stamped metal strut attachment plate of the prior art. The instant invention is constructed of billet aluminum and includes a pair of camber plates. Each of the camber plates includes an inner surface and an outer surface, an upper aperture and a lower elongated aperture. The upper aperture and the lower elongated aperture are arranged to align with the pre-existing strut/spindle mounting apertures located in the OEM strut/spindle mounting flange. The camber plates include an outer contoured perimeter and a rounded lower edge which allow the plates to be snugly fit into the pre-existing strut/spindle mounting flange without interference. The plates fit within the flange sufficiently to allow the inner surfaces of the camber plates to lay juxtaposed to the outer surfaces of the strut/spindle mounting flange for a sandwich type assembly. The outer surface of each camber plate includes a generally rectangular cavity extending inwardly for accepting one of a plurality of offset-plates. The offset-plates have an outer perimeter shaped to conjugately match and fit into the camber plate cavity. Offset-plates are supplied in pairs and are constructed to include apertures positioned offset from the longitudinal centerline of the camber plates in predetermined increments for establishing the desired amount of wheel camber.

In use, the bottom surface of a camber plate is positioned juxtaposed to the outer surfaces of the strut/spindle mounting flange. Matching offset-plates are inserted into the camber plate pockets. Fasteners extend through the camber plates, the offset-plates, and the strut/spindle mounting flanges to secure the spindle in a predetermined position with respect to the strut. The offset-plates are constructed and arranged to cooperate with the existing spindle attachment bolts to control the camber angle of the spindle and thus the respective wheel. This allows the user to select a pair of offset-plates constructed to establish a desired wheel camber setting. Further alterations of camber settings merely require selecting and changing the offset-plates to a new desired set-up. Wheel camber can thus be altered throughout an increased range without changing the strut angle or the roll center of the vehicle.

In addition, the sandwich construction of the strut/spindle mounting flange and the camber plates assembly significantly increases rigidity and stability of the front suspension assembly. For further increased rigidity and stability, the kit may also include an upper strut mount adapted to replace the OEM stamped camber plate. The upper strut mount secures the upper end of the strut in a predetermined position with respect to the strut tower. The upper strut mount includes a centrally located bore constructed to cooperate with the top portion of the strut, and the outer portion of the upper strut mount includes a resilient, preferably urethane, element for isolating vibration. The upper mount is generally annular shaped with an enlarged head and preferably includes a threaded portion which extends upwardly through the mounting member of the vehicle's strut tower. A resilient element is placed on each side of the mounting member and a threaded nut cooperates with the threaded portion extending through the mounting member of the vehicle's strut tower to allow the upper portion of the strut to be secured in a selected position with respect to the strut tower.

The suspension tuning kit may be installed on either one or both sides of the front suspension of the vehicle and the camber angle of each spindle may be independently adjusted to suit the drivers needs.

Accordingly, it is an objective of the present invention to provide a suspension tuning kit for vehicles with struts.

An additional objective of the present invention is to provide a suspension tuning kit for vehicles with struts which allows wheel camber changes without alteration of the vehicle's roll center.

It is a further objective of the present invention to provide a suspension tuning kit for vehicles with struts that allows spindle angle alterations with respect to the strut to control wheel camber angle.

A still further objective of the present invention is to provide a suspension tuning kit for vehicles with struts which includes sandwich construction to provide additional rigidity and support to the vehicle suspension system.

Another objective of the present invention is to provide a suspension tuning kit for vehicles with struts which is simple to install and is ideally suited for original equipment and aftermarket installations.

Yet another objective of the present invention is to provide a suspension tuning kit for vehicles with struts that can be inexpensively manufactured, and is simple and reliable in operation.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention is described in terms of a preferred specific embodiment, it will be readily apparent to those skilled in this art that various modifications, rearrangements and substitutions can be made without departing from the spirit of the invention. The scope of the invention is defined by the claims appended hereto.

Figure 1:
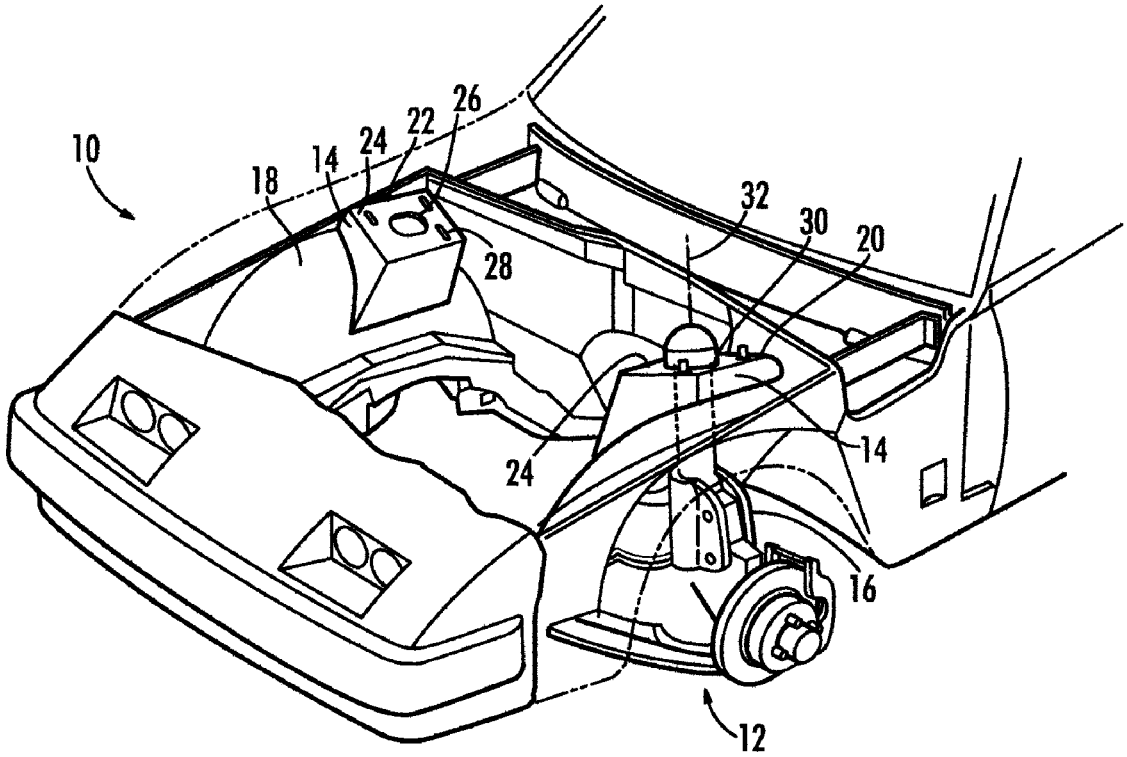
FIG. 1 is a perspective view illustrating the front portion of a vehicle equipped with strut front suspension.

Referring to FIG. 1, the front portion of a vehicle 10 equipped with a strut suspension is shown. The strut suspension 12 includes a pair of strut towers 14. The strut towers are typically formed from sheet metal by methods well known in the art and are secured to the inner fender wall structure 18 on both the left side 20 and right side 22 of the vehicle. Each strut tower includes a mounting member 24 oriented in a plane substantially orthogonal with respect to the longitudinal axis 32 of the corresponding strut 16. The mounting member 24 generally includes a strut aperture 26 and three elongated camber adjustment slots 28. The elongated camber adjustment slots are arranged generally parallel with respect to each other and spaced around the strut axis 32. The upper end of a strut member 16 is secured to the mounting member via a stamped sheet metal member 30. The sheet metal member 30 cooperates with the three camber adjustment slots 28 to permit the upper end of the strut member to be pivoted inward toward the center of the car for a small amount of camber adjustment.

Figure 2:
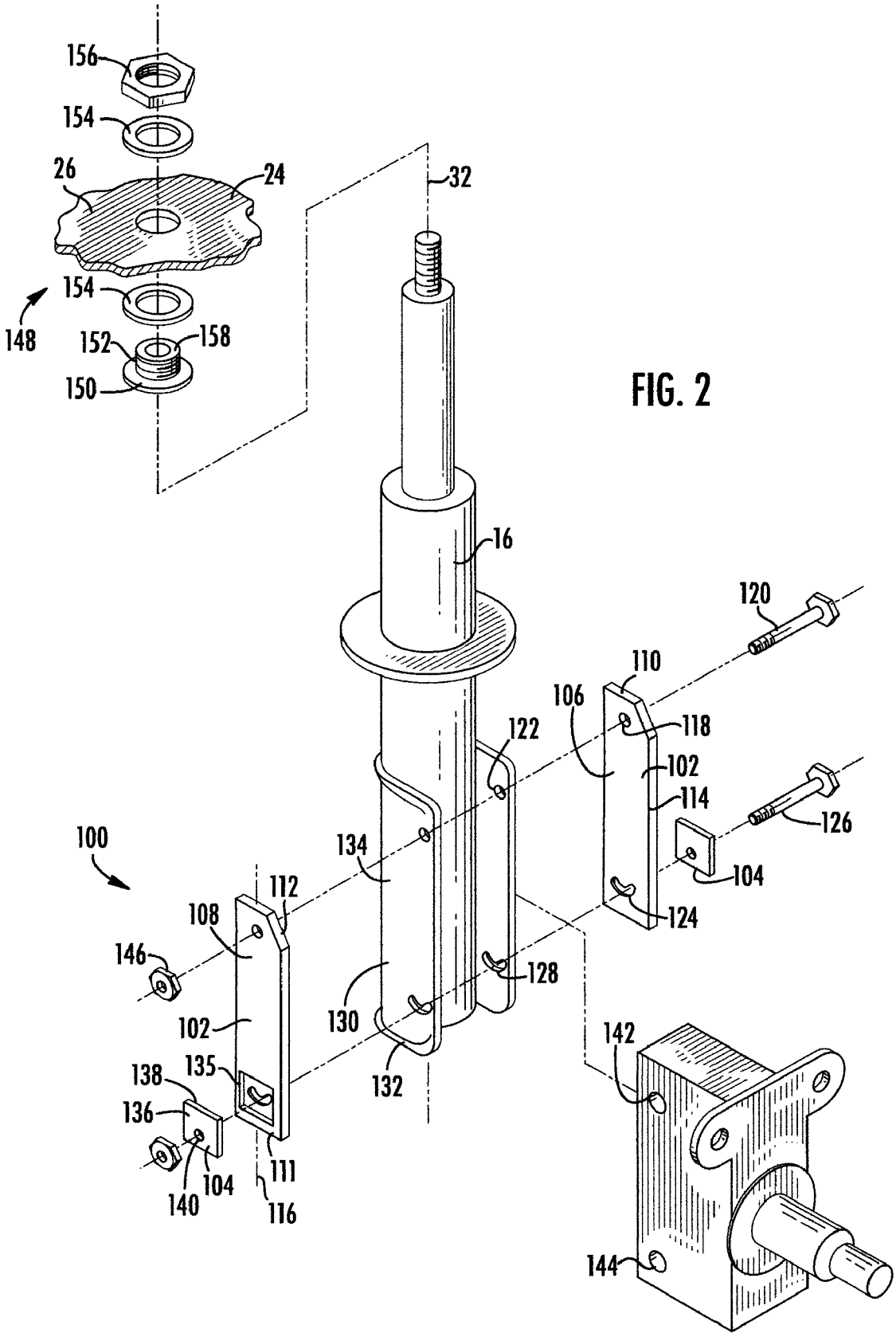
FIG. 2 is a perspective exploded view of the instant invention and a portion of the strut tower mounting member of the vehicle illustrated in FIG. 1.

Referring to FIG. 2, an exploded view of the instant invention is illustrated in conjunction with a standard strut member 16, the spring member is omitted for clarity. The instant invention provides a suspension tuning kit 100 which replaces the stamped metal strut attachment plate 30 (FIG. 1) of the prior art. The suspension tuning kit 100 comprises a pair of camber plates 102 and at least one pair of offset-plates 104.

Figure 3:
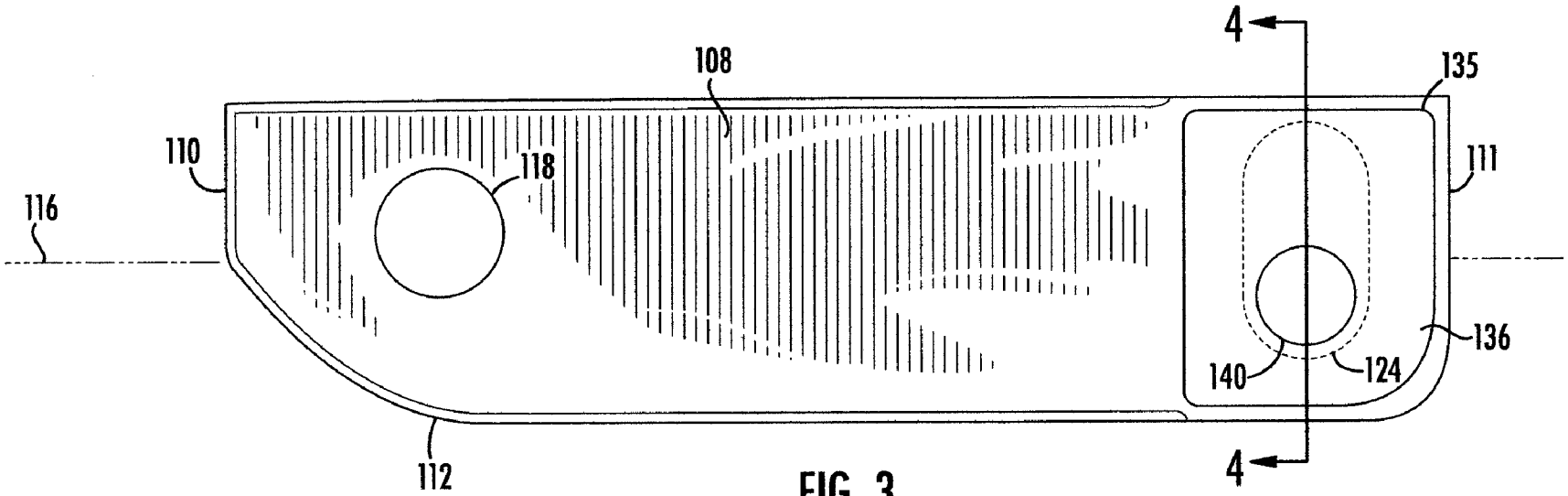
FIG. 3 is a top view of the camber plate of the instant invention.
Figure 4:
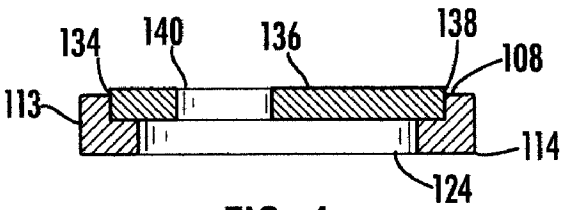
FIG. 4 is a section view of the camber plate taken along lines 1—1 of FIG. 3.

Referring to FIGS. 2–4, the camber plate 102 includes an inner surface 106, an outer surface 108, a top end 110, a bottom end 111, a contoured perimeter 112, a rounded bottom edge 114, and a longitudinal centerline 116. The top end 110 includes a first transverse bore 118 positioned generally along the longitudinal centerline 116. The first transverse bore 118 is generally positioned to align with the top spindle attachment fastener 120 and the top strut/spindle flange aperture 122. The bottom end 111 includes a second elongated transverse bore 124. The second transverse bore 124 is positioned to align with a bottom spindle attachment fastener 126 and the bottom strut/spindle flange aperture 128. While the bottom strut/spindle flange aperture 128 is generally provided from the OEM supplier as a round aperture, the instant invention preferably utilizes an elongated arcuate shaped aperture. The OEM aperture may be modified by means well known in the art such as die grinders, files, milling machines and the like.

When the inner surfaces 106 of the camber plates 102 are positioned juxtaposed to an outer surface 130 of the strut/spindle flange 134 the rounded bottom edge 114 allows the camber plate 102 to abut the depending support lip 132 without interference.

The camber plate 102 also includes a contoured cavity 135 which extends inward into the camber plate 102 from the outer surface 108 and the second transverse bore 124 is centrally located within the contoured cavity. The cavity 135 is generally constructed and arranged to secure and locate an offset-plate 136. The offset-plate 136 includes an outer perimeter 138 conjugately shaped with respect to the cavity 135 so that the offset plate 136 fits snugly into the cavity. Located in the offset-plate is an offset aperture 140. The aperture 140 is offset a predetermined amount with respect to the camber plate longitudinal centerline 116. In a most preferred embodiment the kit 100 is supplied with a plurality of pairs of offset-plates 136 with each pair having apertures 140 offset in predetermined increments. In this embodiment, each set of offset-plates are constructed to result in a different amount of wheel camber when assembled. For example, the offset plates 136 could include apertures 140 that allow camber adjustment from negative three degrees to positive six degrees. The apertures in the offset-plates are preferably positioned for one half degree increments in camber angle, however, the plates may be constructed to include any desired offset increment without departing from the scope of the invention. It should be appreciated that the cavity 135 and the cooperating offset-plates 136 could also be utilized at the top end 110 of the camber plates 102 without departing from the scope of the invention.

In a most preferred and non-limiting embodiment, the camber plates 102 are constructed of billet aluminum and are about 0.350 of an inch thick and the cavity depth is about 0.120. It should be appreciated that the camber plate 102 may be made thinner or thicker, and the cavity 135 depth may be varied as the space requirements, materials and wheel loads require. In the most preferred embodiment, the offset-plates 102 are constructed of steel and are about one eighth of an inch thick. It should also be appreciated that to accommodate space, material and wheel load requirements the camber plate 102 and/or the offset-plates 136 may alternatively be made from other ferrous or non-ferrous metals which may include, but should not be limited to, steel, titanium, brass, bronze or suitable combinations thereof.

In use, the camber plates 102 are positioned parallel and juxtaposed to the outer surface of the strut/spindle flange and offset-plates are selected for the desired wheel camber and are thereafter inserted into the cavities. Threaded fasteners 120 and 126 extend through the first and second transverse bores 118, 124, offset apertures 140, strut/spindle bores 122, 128, and spindle bores 142, 144 to cooperate with threaded nuts 146. The thickness and contour of the camber plates cooperate with the strut/spindle mounting flange 134 and its depending lip 132 to create a sandwich type of construction that has substantially increased rigidity and strength when compared to the OEM configuration. In this manner, the front wheel camber of a vehicle may be selectively adjusted throughout an extended range.

Referring to FIGS. 1 and 2, the upper strut mount 148 is illustrated. In general, the upper strut mount is constructed and arranged to replace the stamped sheet metal OEM upper strut mount 30 (FIG. 1). The upper strut mount 148 includes a head portion 150, an annular portion 152, a pair of resilient members 154, and a threaded nut member 156. The annular portion 152 includes a central bore 158 sized to fit over the upper portion of the strut member 16. The outer surface of the annular portion 152 includes integrally formed threads which cooperate with an internal threaded surface in nut member 156. In use, the central bore 158 is placed over the upper end of the strut member and the annular portion 152 is extended upwardly through the mounting member 24 of the vehicle's strut tower 14. A resilient element 154 is placed on each side of the mounting member 24 and the threaded nut cooperates with the external threads extending through the mounting member of the vehicle's strut tower to allow the upper portion of the strut to be secured in a selected position with respect to the strut tower.

In a most preferred and non-limiting embodiment, the upper mount is constructed of billet aluminum; however, it should be noted that other metals well known in the art which may include but should not be limited to steel, titanium and the like may also be utilized.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. In a front vehicle suspension, wherein said suspension includes a left and a right strut, each said strut including an upper end, a bottom end and a first longitudinal centerline, said first longitudinal centerline defining a strut axis, a left and a right structural strut tower, said left and said right strut towers each including a mounting member oriented in a plane substantially orthogonal with said respective left and said right strut axes, said mounting members each including a central aperture, wherein said upper end of said left strut attaches to said left strut tower mounting member via said central aperture, wherein said upper end of said right strut attaches to said right strut tower mounting member via said central aperture, wherein said bottom end of said left and said right strut includes a flange, said flange including an upper bore and a lower bore for attachment of a spindle via an upper threaded fastener and a lower threaded fastener, a suspension tuning kit comprising:

a pair of camber plates, each having an inner surface, an outer surface, a top end, a bottom end, a contoured perimeter, and a second longitudinal centerline, wherein said second longitudinal centerline extends from said top end to said bottom end, said top end including a first transverse bore positioned generally along said second longitudinal centerline, said first transverse bore constructed and arranged to cooperate with a top spindle attachment fastener, said bottom end including a second transverse bore, said second transverse bore constructed and arranged to cooperate with a bottom spindle attachment fastener, wherein said inner surfaces of said camber plates are positioned juxtaposed to an outer surface of said flange, wherein said inner or said outer surface of each said camber elate includes a cavity therein, wherein said cavity is constructed and arranged to secure and locate an offset-plate, said cavity including a contoured perimeter wall, said perimeter wall surrounding at least one of said first or said second transverse bores, wherein said offset-plate includes an outer contoured perimeter conjugately shaped with respect to said contoured perimeter wall of said cavity so that said offset plate fits snugly into said cavity, wherein said offset-plate includes an aperture therethrough, said aperture offset a predetermined amount with respect to said second longitudinal centerline;

wherein said kit may be secured to said left or said right strut flange, whereby said first bore and said offset plate aperture align with said upper and said lower bores in said strut flange and wherein said top and bottom spindle attachment fasteners extend through said camber plates, said flange and said spindle, wherein said top and bottom spindle attachment fasteners cooperate with threaded nuts to secure said suspension tuning kit to said front vehicle suspension, wherein spindle camber angle is adjustable throughout an extended range, whereby said strut axis remains unchanged.

2. The suspension tuning kit as set forth in claim 1 including a plurality of pairs of said offset-plates, wherein each of said pair of offset-plates include apertures offset a predetermined amount to facilitate adjusting wheel camber up to about nine degrees.

3. The suspension tuning kit as set forth in claim 2, wherein each of said pairs of offset-plates include apertures offset a predetermined amount to facilitate adjusting wheel camber from about negative three degrees to about positive six degrees.

4. The suspension tuning kit as set forth in claim 2, wherein said apertures in each of said pairs of offset-plates are provided in one fourth degree increments.

5. The suspension tuning kit as set forth in claim 2, wherein said apertures in each of said pairs of offset-plates are provided in one half degree increments.

6. The suspension tuning kit as set forth in claim 2, wherein said apertures in each of said pairs of offset-plates are provided in one degree increments.

7. The suspension tuning kit as set forth in claim 1, wherein said camber plate includes at least one rounded edge extending between said inner surface and said contoured edge, wherein said rounded corner is constructed and arranged to abut a depending lip extending at least partially around the perimeter of said strut flange.

8. The suspension tuning kit as set forth in claim 1, wherein said camber plate is constructed from metal.

9. The suspension tuning kit as set forth in claim 1, wherein said camber plate is constructed from steel.

10. The suspension tuning kit as set forth in claim 1, wherein said camber plate is constructed from aluminum.

11. The suspension tuning kit as set forth in claim 1, wherein said camber plate is constructed from titanium.

12. The suspension tuning kit as set forth in claim 1, wherein said offset-plate is constructed from metal.

13. The suspension tuning kit as set forth in claim 1, wherein said offset-plate is constructed from steel.

14. The suspension tuning kit as set forth in claim 1, wherein said offset-plate is constructed from aluminum.

15. The suspension tuning kit as set forth in claim 1, wherein said offset-plate is constructed from titanium.

* * * * *